US009868185B2

(12) United States Patent
Lefevre et al.

(10) Patent No.: US 9,868,185 B2
(45) Date of Patent: Jan. 16, 2018

(54) POLISHING PAD WITH FOUNDATION LAYER AND WINDOW ATTACHED THERETO

(71) Applicant: Cabot Microelectronics Corporation, Aurora, IL (US)

(72) Inventors: Paul Andre Lefevre, Portland, OR (US); William C. Allison, Beaverton, OR (US); Diane Scott, Portland, OR (US); Jose Arno, Portland, OR (US)

(73) Assignee: Cabot Microelectronics Corporation, Aurora, IL (US)

( * ) Notice: Subject to any disclaimer, the term of this patent is extended or adjusted under 35 U.S.C. 154(b) by 16 days.

(21) Appl. No.: 14/931,737

(22) Filed: Nov. 3, 2015

(65) Prior Publication Data

US 2017/0120417 A1 May 4, 2017

(51) Int. Cl.
*B24B 37/22* (2012.01)

(52) U.S. Cl.
CPC ..... *B24B 37/22* (2013.01)

(58) Field of Classification Search
CPC ..... B24B 37/22; B24B 37/24; B24B 37/205; B24B 37/12; B24B 37/14; B24B 37/20
See application file for complete search history.

(56) References Cited

U.S. PATENT DOCUMENTS 5,893,796 A * 4/1999 Birang ..... B24B 37/013 451/283
6,358,130 B1 * 3/2002 Freeman ..... B24B 37/205 451/285
6,524,164 B1 * 2/2003 Tolles ..... B24B 37/013 451/28
6,719,818 B1 * 4/2004 Birang ..... B24B 37/013 428/131
6,832,950 B2 * 12/2004 Wright ..... B24B 37/205 156/277

(Continued)

FOREIGN PATENT DOCUMENTS

TW 200408494 A 6/2004
TW 200526355 A 8/2005

(Continued)

OTHER PUBLICATIONS

Taiwan Intellectual Property Office, Search Report issued in connection with Taiwan Patent Application No. 105135433 dated Aug. 15, 2017.

*Primary Examiner* — Dung Van Nguyen
(74) *Attorney, Agent, or Firm* — Thomas Omholt; Erika S. Wilson

(57) ABSTRACT

Polishing pads having a foundation layer and a window attached to the foundation layer, and methods of fabricating such polishing pads, are described. In an example, a polishing pad for polishing a substrate includes a foundation layer having a first modulus. A polishing layer is attached to the foundation layer and has a second modulus less than the first modulus. A first opening is through the polishing layer and a second opening is through the foundation layer. The first opening exposes at least a portion of the second opening and exposes a portion of the foundation layer. A window is disposed in the first opening and is attached to the exposed portion of the foundation layer.

28 Claims, 7 Drawing Sheets

(56) References Cited

U.S. PATENT DOCUMENTS

| | | | | |
|---|---|---|---|---|
| 6,984,163 | B2 * | 1/2006 | Roberts | B24B 37/205 451/28 |
| 6,997,777 | B2 | 2/2006 | Newell | |
| 7,179,151 | B1 | 2/2007 | Bottema et al. | |
| 8,858,298 | B2 * | 10/2014 | Swedek | B24B 37/013 451/41 |
| 9,597,769 | B2 | 3/2017 | Lefevre et al. | |
| 9,636,796 | B2 * | 5/2017 | Nakamura | B24B 37/205 |
| 2004/0094855 | A1 | 5/2004 | Shih et al. | |
| 2005/0266771 | A1 | 12/2005 | Wiswesser | |
| 2014/0242894 | A1 | 8/2014 | Itoyama et al. | |
| 2014/0256225 | A1 | 9/2014 | Repper et al. | |
| 2014/0273762 | A1 | 9/2014 | Alagarsamy et al. | |
| 2015/0273655 | A1 | 10/2015 | Allison et al. | |

FOREIGN PATENT DOCUMENTS

| | | | |
|---|---|---|---|
| TW | 200744796 | A | 12/2007 |
| TW | 201321493 | A | 6/2013 |
| TW | 201404532 | A | 2/2014 |
| TW | 201446412 | A | 12/2014 |

* cited by examiner

POLISHING PAD WITH FOUNDATION LAYER AND WINDOW ATTACHED THERETO

TECHNICAL FIELD

Embodiments of the present invention are in the field of chemical mechanical polishing (CMP) and, in particular, polishing pads having a foundation layer and a window attached to the foundation layer, and methods of fabricating such polishing pads.

BACKGROUND

Chemical-mechanical planarization or chemical-mechanical polishing, commonly abbreviated CMP, is a technique used in semiconductor fabrication for planarizing a semiconductor wafer or other substrate.

The process uses an abrasive and corrosive chemical slurry (commonly a colloid) in conjunction with a polishing pad and retaining ring, typically of a greater diameter than the wafer. The polishing pad and wafer are pressed together by a dynamic polishing head and held in place by a plastic retaining ring. The dynamic polishing head is rotated during polishing. This approach aids in removal of material and tends to even out any irregular topography, making the wafer flat or planar. This may be necessary in order to set up the wafer for the formation of additional circuit elements. For example, this might be necessary in order to bring the entire surface within the depth of field of a photolithography system, or to selectively remove material based on its position. Typical depth-of-field requirements are down to Angstrom levels for the latest sub-50 nanometer technology nodes.

The process of material removal is not simply that of abrasive scraping, like sandpaper on wood. The chemicals in the slurry also react with and/or weaken the material to be removed. The abrasive accelerates this weakening process and the polishing pad helps to wipe the reacted materials from the surface. In addition to advances in slurry technology, the polishing pad plays a significant role in increasingly complex CMP operations.

However, additional improvements are needed in the evolution of CMP pad technology.

SUMMARY

Embodiments of the present invention include polishing pads having a foundation layer and a window attached to the foundation layer, and methods of fabricating such polishing pads.

In an embodiment, a polishing pad for polishing a substrate includes a foundation layer having a first modulus. A polishing layer is attached to the foundation layer and has a second modulus less than the first modulus. A first opening is through the polishing layer and a second opening is through the foundation layer. The first opening exposes at least a portion of the second opening and exposes a portion of the foundation layer. A window is disposed in the first opening and is attached to the exposed portion of the foundation layer.

In another embodiment, a method of fabricating a polishing pad for polishing a substrate includes forming a first opening through a polishing layer. The polishing layer has a polishing side and a back side and having a modulus. The method further includes attaching a foundation layer to the back side of the polishing layer. The foundation layer has a modulus greater than the modulus of the polishing layer. The method further includes, subsequent to attaching the foundation layer to the back side of the polishing layer, forming a second opening through the foundation layer. The first opening exposes at least a portion of the second opening and exposes a portion of the foundation layer. The method further includes inserting a window in the first opening and attaching the window to the exposed portion of the foundation layer.

In another embodiment, a method of fabricating a polishing pad for polishing a substrate includes forming a first opening through a polishing layer. The polishing layer has a polishing side and a back side and has a modulus. The method also includes forming a second opening through a foundation layer. The foundation layer has a polishing side and a back side and has a modulus greater than the modulus of the polishing layer. The method also includes attaching a window to the polishing side of the foundation layer. The window covers at least a portion of the second opening. The method also includes, subsequent to attaching the window to the polishing side of the foundation layer, attaching the polishing layer to the foundation layer. The first opening formed through the polishing layer surrounds the window.

DETAILED DESCRIPTION

Figure 1A:
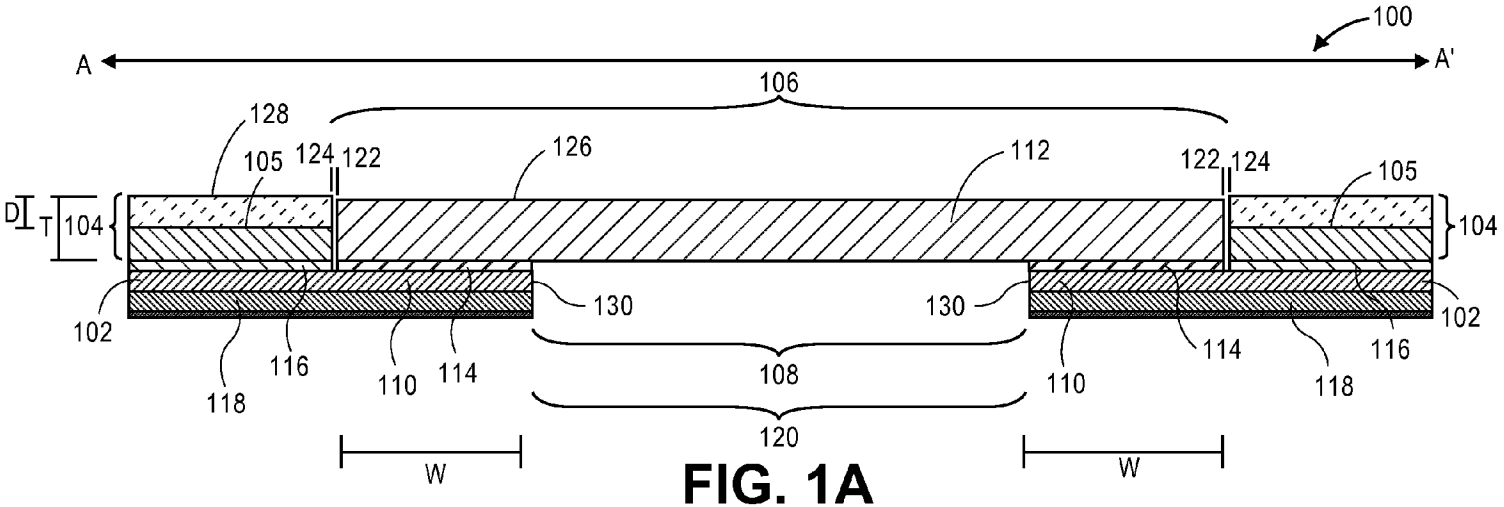
FIG. 1A illustrates a cross-sectional view, taken along the A-A' axis of FIG. 1B, of a polishing pad with a window housed within an opening in a polishing layer and attached with an adhesive layer to an underlying foundation layer, in accordance with an embodiment of the present invention.

Polishing pads having a foundation layer and a window attached to the foundation layer, and methods of fabricating such polishing pads, are described herein. In the following description, numerous specific details are set forth, such as specific polishing pad architectures, designs and compositions, in order to provide a thorough understanding of embodiments of the present invention. It will be apparent to one skilled in the art that embodiments of the present invention may be practiced without these specific details. In other instances, well-known processing techniques, such as details concerning the combination of a slurry with a polishing pad to perform CMP of a semiconductor substrate, are not described in detail in order to not unnecessarily obscure embodiments of the present invention. Furthermore, it is to be understood that the various embodiments shown in the figures are illustrative representations and are not necessarily drawn to scale.

One or more embodiments described herein are directed to polishing pads having a window attached to an underlying to the foundation layer of the polishing pad. The window provides an avenue for optical end-point detection of a CMP process as monitored through the polishing pad, even in the case that the polishing pad includes an opaque polishing layer.

To provide context, traditional approaches to incorporating a window into a polishing pad have included attaching the window to an underlying sub pad. However, the sub pad is typically a low density foam (or low density impregnated felt) and does not necessarily offer good mechanical strength. For example, attaching the window to a sub pad has been known to lead to window issues during CMP processing, such as slurry leakage and window pop-out. Another approach has been to attach the window to the pad itself. However, such an approach requires that the pad is thicker than the window, which can lead to either an overly thin window or an overly thick pad. An overly thin window can lead to CMP issues at the end of the pad life. An overly thick pad, on the other hand, provides limited design options for tuning CMP performance. One or more embodiments, described herein address such issues by including a window attached to a foundation layer of a polishing pad.

To provide further context, polishing pads for CMP operations may have trade-offs in performance such as a trade-off between across-wafer polishing uniformity versus within die polishing uniformity. For example, hard polishing pads may exhibit good die-level planarization, but poor across-wafer uniformity. They may also scratch a substrate being polished. On the other hand, soft polishing pads may exhibit poor die-level planarization (e.g., they may cause dishing within die), but good wafer-level uniformity. An approach to mitigating the above performance trade-off may be to decouple within-wafer and within-die polishing effects. One or more embodiments, described herein address such issues by including a foundation layer together with a polishing layer.

Figure 1B:
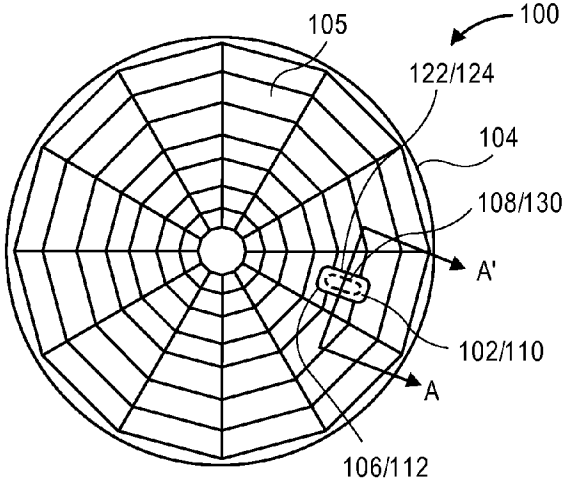
FIG. 1B illustrates a plan view of the polishing pad of FIG. 1A in accordance with an embodiment of the present invention.

A first exemplary polishing pad includes a foundation layer having a window attached to the foundation layer by an adhesive layer. For example, FIG. 1A illustrates a cross-sectional view, taken along the A-A' axis of FIG. 1B, of a polishing pad with a window housed within an opening in a polishing layer and attached with an adhesive layer to an underlying foundation layer, in accordance with an embodiment of the present invention. FIG. 1B illustrates a plan view of the polishing pad of FIG. 1A.

Referring to FIGS. 1A and 1B, a polishing pad 100 for polishing a substrate includes a foundation layer 102 having a first modulus. A polishing layer 104 is attached to the foundation layer 102. The polishing layer 104 has a second modulus less than the first modulus. A first opening 106 is through the polishing layer 104. A second opening 108 is through the foundation layer 102. From a plan view perspective, the first opening 106 exposes at least a portion of the second opening 108 and exposes a portion 110 of the foundation layer 102. In one such embodiment, the first opening 106 exposes the entire second opening 108, as is depicted in FIGS. 1A and 1B. A window 112 is disposed in the first opening 106 and is attached to the exposed portion 110 of the foundation layer 102.

With reference to FIG. 1A, in an embodiment, the window 112 is attached to the exposed portion 110 of the foundation layer 102 by an adhesive layer 114. In one embodiment, the adhesive layer 114 is one such as, but not limited to a pressure sensitive adhesive (PSA) layer, a two-component epoxy layer, a UV-cured resin layer, a silicone-based adhesive layer, a transfer tape layer, or a hot melt layer. In a specific such embodiment, the adhesive layer 114 is a non-differential two-sided tape PSA layer. In another specific such embodiment, the adhesive layer 114 is a first two-sided tape PSA layer, and the polishing layer 104 is attached to the foundation layer 102 using a second two-sided tape PSA layer 116. In a particular such embodiment, the second two-sided tape PSA layer 116 has a thickness approximately the same as a thickness of the first two-sided tape PSA layer 114 attaching the window 112 to the foundation layer 102, as is depicted in FIG. 1A. In another embodiment, the adhesive layer 114 is a differential two-sided tape PSA layer.

Referring again to FIG. 1A, in an embodiment, the polishing pad 100 further includes a sub pad 118 attached to the foundation layer 102 on a side of the foundation layer 102 opposite the polishing layer 104. In one such embodiment, a third opening 120 is through the sub pad 118. The third opening 120 is substantially sized and aligned with the second opening 108, as is depicted in FIG. 1A. In an embodiment, the sub pad 118 is composed of a material such as, but not limited to, foam, rubber, fiber, felt or a highly porous material. In an embodiment, the sub pad 118 has a hardness less than approximately 90 Shore A.

Referring again to FIG. 1A, in an embodiment, the window 112 is substantially planar on both upper and lower surfaces. In one such embodiment, no portion of the window 112 extends into the second opening 108, as is depicted in FIG. 1A. In another embodiment, however, a portion of the window 112 is disposed in the second opening. In one such embodiment, the window may be described as a T-shaped plug for the openings 106 and 108.

Referring to FIG. 1B, in an embodiment, from a plan view perspective of the polishing layer 104, the window 112 has substantially a same shape as the first opening 108. In one such embodiment, the shape is one such as, but not limited to, a circle, an oval, a square, a rectangle, and a rectangle having rounded corners (the last embodiment depicted in the example illustrated in FIG. 1B). In an embodiment, referring to FIG. 1A, a perimeter 122 of the window 112 is reduced in size at all portions of the perimeter by an amount approximately in the range of 5-15 mils relative to a perimeter 124 of the first opening 106. That is, the window 112 is sized to fit in opening 106 without contacting the polishing layer 104, or at least without contacting the polishing layer 104 at all surfaces of the perimeter 122 of the window 112. In an embodiment, the window 112 has an uppermost surface 126 lower than an uppermost surface 128 of the polishing layer 104. That is, the window 112 is recessed relative to the polishing layer 104, as is depicted in FIG. 1A.

Referring again to FIG. 1B, in an embodiment, from a plan view perspective of the polishing layer 104, the first opening 106 has substantially a same shape as the second opening 108. In one such embodiment, a perimeter 130 of the second opening 108 is reduced in size at all portions of the perimeter by an amount approximately in the range of 10-500 mils relative to the perimeter 124 of the first opening 106. In a particular such embodiment, the perimeter 130 of the second opening 108 is reduced in size at all portions of the perimeter by an amount approximately in the range of 100-300 mils relative to the perimeter 124 of the first opening 106. With reference to FIG. 1A, such an embodiment provides the exposed portions 110 of the foundation layer 102 as having a width (W) approximately in the range of 100-300 mils and, preferably, approximately in the range of 100-300 mils.

In an embodiment, the window 112 is composed of a material transparent to a broad spectrum irradiation approximately in the range of 300-800 nanometers. In an embodiment, the window 112 is composed of a material such as, but not limited to, a polyethylene terephthalate material, a polyurethane material, a cyclic olefin copolymer material, a polycarbonate material, a polyester material, a polypropylene material, or a polyethylene material.

In an embodiment, the foundation layer 102 is composed of a material such as, but not limited to, a polycarbonate material, an epoxy board material, a polyurethane material, a composite fiber board, a polymethylmethacrylate (PMMA) material, or a cyclic olefin copolymer material. In an embodiment, the foundation layer 102 has an energy loss factor of less than approximately 100 KEL at 1/Pa at 40° C. KEL is parameter for predicting polishing performance. ASTM D4092-90 ("Standard Terminology Relating to Dynamic Mechanical Measurements of Plastics") defines this parameter as the energy per unit volume lost in each deformation cycle. In other words, it is a measure of the area within the stress-strain hysteresis loop. The Energy Loss Factor (KEL) is a function of both tan δ and the elastic storage modulus (E') and may be defined by the following equation: $KEL=\tan\delta*10^{12}/[E'*(1+\tan\delta^2)]$ where E' is in Pascals. The ratio of elastic stress to strain is the storage (or elastic) modulus and the ratio of the viscous stress to strain is the loss (or viscous) modulus. When testing is performed in tension, flex, or compression, E' and E" designate the storage and loss modulus, respectively. The ratio of the loss modulus to the storage modulus is the tangent of the phase angle shift (δ) between the stress and the strain. Thus, $E''/E'=\tan\delta$ and is a measure of the damping ability of the material.

In an embodiment, the polishing layer 104 is composed of a thermoset polyurethane material. In one such embodiment, the foundation layer 102 is composed of a polycarbonate layer, and the window 112 is composed of a polyethylene terephthalate material. In an embodiment, the polishing layer 104 has an energy loss factor of greater than approximately 1000 KEL at 1/Pa at 40° C. Referring to FIGS. 1A and 1B, in an embodiment, the polishing layer 104 has grooves 105 disposed therein. In one such embodiment, the grooves 105 are formed to a depth (D) of approximately 10%-60% of a total thickness (T) of the polishing layer 104. In a particular such embodiment, the grooves 105 are formed to a depth (D) of approximately half of the total thickness (T) of the polishing layer 104. In an embodiment, the grooves 105 have a pattern of concentric polygons and radial grooves, as is depicted in FIG. 1B. In other embodiments, the radial grooves are omitted. It is to be appreciated that other design choices for a pattern of grooves 105 may also be used.

In an embodiment, the polishing layer 104 is a homogeneous polishing layer. In one such embodiment, the homogeneous polishing layer is composed of a thermoset polyurethane material. For example, in a specific embodiment, the homogeneous polishing layer is composed of a thermoset, closed cell polyurethane material. In an embodiment, the term "homogeneous" is used to indicate that the composition of a thermoset, closed cell polyurethane material is consistent throughout the entire composition of the polishing layer 104. For example, in an embodiment, the term "homogeneous" excludes polishing layers composed of, e.g., impregnated felt or a composition (composite) of multiple layers of differing material. In an embodiment, the term "thermoset" is used to indicate a polymer material that irreversibly cures, e.g., the precursor to the material changes irreversibly into an infusible, insoluble polymer network by curing. For example, in an embodiment, the term "thermoset" excludes polishing pads composed of, e.g., "thermoplast" materials or "thermoplastics"—those materials composed of a polymer that turns to a liquid when heated and returns to a very glassy state when cooled sufficiently. It is noted that polishing pads made from thermoset materials are typically fabricated from lower molecular weight precursors reacting to form a polymer in a chemical reaction, while pads made from thermoplastic materials are typically fabricated by heating a pre-existing polymer to cause a phase change so that a polishing pad is formed in a physical process. Polyurethane thermoset polymers may be selected for fabricating polishing pads described herein based on their stable thermal and mechanical properties, resistance to the chemical environment, and tendency for wear resistance. In an embodiment, although the polishing layer 104 is composed of a thermoset material, the corresponding foundation layer 102 is composed of a thermoplastic material, such as a polycarbonate.

The material of polishing layer 104 may be molded. The term "molded" may be used to indicate that the polishing layer 104 is formed in a formation mold. In an embodiment, the molded polishing layer 104, upon conditioning and/or polishing, has a polishing surface roughness approximately in the range of 1-5 microns root mean square. In one embodiment, the molded polishing layer 104, upon conditioning and/or polishing, has a polishing surface roughness of approximately 2.35 microns root mean square.

The material of polishing layer 104 may include pore-forming features. In an embodiment, the polishing layer 104 has a pore density of closed cell pores approximately in the range of 6%-50% total void volume. In one embodiment, the plurality of closed cell pores is a plurality of porogens. For example, the term "porogen" may be used to indicate micro- or nano-scale spherical or somewhat spherical particles with "hollow" centers. The hollow centers are not filled with solid material, but may rather include a gaseous or liquid core. In one embodiment, the plurality of closed cell pores is composed of pre-expanded and gas-filled EXPANCEL™ distributed throughout (e.g., as an additional component in) the polishing layer 104 of the polishing pad 100. In a specific embodiment, the EXPANCEL™ is filled with pentane. In an embodiment, each of the plurality of closed cell pores has a diameter approximately in the range of 10-100 microns. In an embodiment, the plurality of closed cell pores includes pores that are discrete from one another. This is in contrast to open cell pores which may be connected to one another through tunnels, such as the case for the pores in a common sponge. In one embodiment, each of the closed cell pores includes a physical shell, such as a shell of a porogen, as described above. In another embodiment, however, each of the closed cell pores does not include a physical shell. In an embodiment, the plurality of closed cell pores is distributed essentially evenly throughout a thermoset polyurethane material of the polishing layer 104. In an embodiment, although the polishing layer 104 includes pore-forming features, the corresponding foundation layer 102 does not and is non-porous.

In an embodiment, the polishing layer 104 is opaque. In one embodiment, the term "opaque" is used to indicate a material that allows approximately 10% or less visible light to pass. In one embodiment, the polishing layer 104 is opaque in most part, or due entirely to, the inclusion of an opacifying particle filler, such as a lubricant, throughout (e.g., as an additional component in) the polishing layer 104. In a specific embodiment, the opacifying particle filler is a material such as, but not limited to boron nitride, cerium fluoride, graphite, graphite fluoride, molybdenum sulfide, niobium sulfide, talc, tantalum sulfide, tungsten disulfide, or Teflon®.

The grooves 105 of the polishing layer 104 may have a pattern suitable for polishing during a CMP operation. Individual grooves 105 may be from about 2 to about 100 mils wide at any given point on each groove. In some embodiments, the grooves 105 are about 15 to about 50 mils wide at any given point on each groove. The grooves 105 may be of uniform width, variable width, or any combinations thereof. In some embodiments, the grooves 105 of a groove pattern are all of uniform width. In some embodiments, however, some of the grooves 105 of a groove pattern have a certain uniform width, while other grooves of the same pattern have a different uniform width. In some embodiments, groove width increases with increasing distance from the center of the polishing layer 104. In some embodiments, groove width decreases with increasing distance from the center of the polishing layer 104. In some embodiments, grooves 105 of uniform width alternate with grooves 105 of variable width.

In accordance with the previously described depth and width dimensions, individual grooves 105 may be of uniform volume, variable volume, or any combinations thereof. In some embodiments, the grooves 105 are all of uniform volume. In some embodiments, however, groove volume increases with increasing distance from the center of the polishing layer 104. In some other embodiments, groove volume decreases with increasing distance from the center of the polishing layer 104. In some embodiments, grooves of uniform volume alternate with grooves of variable volume.

Grooves 105 of the groove patterns described herein may have a pitch from about 30 to about 1000 mils. In some embodiments, the grooves 105 have a pitch of about 125 mils. For a circular polishing layer 104, groove pitch is measured along the radius of the circular polishing layer 104. In CMP belts, groove pitch is measured from the center of the CMP belt to an edge of the CMP belt. The grooves 105 may be of uniform pitch, variable pitch, or in any combinations thereof. In some embodiments, the grooves are all of uniform pitch. In some embodiments, however, groove pitch increases with increasing distance from the center of the polishing pad. In some other embodiments, groove pitch decreases with increasing distance from the center of the polishing layer 104. In some embodiments, the pitch of the grooves 105 in one sector varies with increasing distance from the center of the polishing layer 104 while the pitch of the grooves 105 in an adjacent sector remains uniform. In some embodiments, the pitch of the grooves 105 in one sector increases with increasing distance from the center of the polishing layer 104 while the pitch of the grooves in an adjacent sector increases at a different rate. In some embodiments, the pitch of the grooves 105 in one sector increases with increasing distance from the center of the polishing layer 104 while the pitch of the grooves 105 in an adjacent sector decreases with increasing distance from the center of the polishing layer 104. In some embodiments, grooves of uniform pitch alternate with grooves of variable pitch. In some embodiments, sectors of grooves of uniform pitch alternate with sectors of grooves of variable pitch.

In an embodiment, when the grooves 105 of the polishing layer 104 are formed during a molding process, the positioning of the resulting polishing layer 104 during formation of the polishing layer 104 in a mold can be determined after removal of the polishing layer 104 from the mold. That is, such a polishing layer 104 may be designed (e.g., with clocking marks) to provide traceability back to the molding process. Thus, in one embodiment, the polishing layer 104 is a molded polishing layer, and a feature included therein indicates a location of a region in a mold used for forming a resulting polishing layer 104.

In an embodiment, as a pairing, a combination of the foundation layer 102 and the polishing layer 104 has an energy loss factor of less than approximately 1000 KEL at 1/Pa at 40° C. In an embodiment, the polishing layer 104 has an elastic storage modulus (E') at 40 degrees Celsius approximately in the range of 50 MPa-100 MPa, and the foundation layer 102 has an elastic storage modulus (E') at 40 degrees Celsius approximately in the range of 1500 MPa-3000 MPa. In an embodiment, the foundation layer 102 has a hardness approximately in the range of 70-90 Shore D, and the polishing layer 104 has a hardness approximately in the range of 20-65 Shore D.

As mentioned in an embodiment above, the polishing layer 104 may be attached to the foundation layer 102 by an adhesive layer 116 such as a PSA layer. In another embodiment, however, the polishing layer 104 is bonded directly to the foundation layer 102. That is, the polishing layer 104 is in direct contact with the foundation layer 102. In one embodiment, then, "bonded directly to" describes direct contact with no intervening layers (such as pressure sensitive adhesive layers) or otherwise glue-like or adhesive films. In a specific such embodiment, the polishing layer 104 is covalently bonded to the foundation layer 102. In an embodiment, the term "covalently bonded" refers to arrangements where atoms from a first material (e.g., the material of a polishing layer) are cross-linked or share electrons with atoms from a second material (e.g., the material of a foundation layer) to effect actual chemical bonding. Covalent bonding is distinguished from mechanical bonding, such as bonding through screws, nails, glues, or other adhesives. In another specific embodiment, the polishing layer 104 is not covalently bonded, but is rather only electrostatically bonded, to the foundation layer 102. Such electrostatic bonding may involve van der Waals type interactions between the foundation layer 102 and the polishing layer 104.

In either case, whether the polishing layer 104 is attached to the foundation layer 102 by an adhesive layer 116 or is bonded directly to the foundation layer 102, peel resistance may provide an indication of the strength and extent to which a polishing layer 104 is coupled with a foundation layer 102. In an embodiment, the foundation layer 102 and the polishing layer 104 have a peel resistance sufficient to withstand a shear force applied during the useful lifetime of the polishing pad 100.

In an embodiment, a surface roughness is used at the interface of the polishing layer 104 and the foundation layer 102 to enhance bond strength of these two portions of the polishing pad 100. In one such embodiment, the foundation layer 102 has a surface roughness greater than approximately 1 micrometer Ra (root mean square). In a specific such embodiment, the surface roughness is approximately in the range of 5-10 micrometers Ra (root mean square). However, in another embodiment, substantial surface roughness is not included and the interface of a polishing layer 104, and the foundation layer 102 is particularly smooth.

The strength of such a smooth interface may be independent of surface roughness or may not need further strengthening by the inclusion of such surface roughness. In one such embodiment, the foundation layer 102 has a smooth surface with a surface roughness less than approximately 1 micrometer Ra (root mean square).

In an embodiment, materials of polishing layer 104 and corresponding foundation layer 102 may each have defined dimensions suitable to provide desired polishing characteristics, either as individual components or collectively for the polishing pad 100 as an entirety. Referring to FIG. 1A, in an embodiment, the polishing layer 104 has a thickness (T) approximately in the range of 2-50 mils, and the corresponding foundation layer 102 thickness of approximately 20 mils. In an embodiment, the foundation layer 102 has a thickness and modulus relative to the thickness and modulus of the polishing layer 104 sufficient to dictate the bulk polishing characteristics of the corresponding polishing pad 100. In an embodiment, the foundation layer 102 is sufficiently thick for the corresponding polishing pad 100 to provide die-level polishing planarity, but sufficiently thin for the polishing pad 100 to provide wafer-level polishing uniformity.

A first exemplary method of fabricating a polishing pad includes attaching a window to a foundation layer subsequent to attaching a polishing layer to the foundation layer. As an example, FIGS. 2A-2I illustrate cross-sectional views representing various operations in a method of fabricating a polishing pad for polishing a substrate, in accordance with an embodiment of the present invention.

Figure 2A:
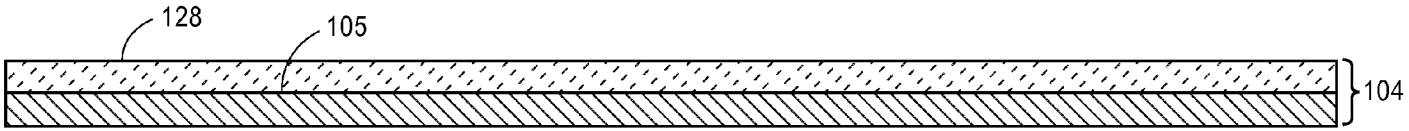
FIGS. 2A-2I illustrate cross-sectional views representing various operations in a method of fabricating a polishing pad for polishing a substrate, in accordance with an embodiment of the present invention.
Figure 2B:
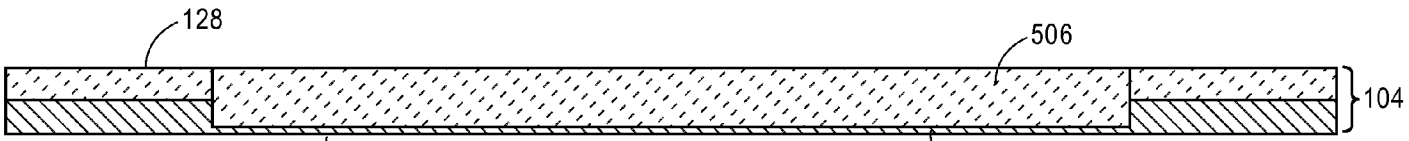
Figure 2C:
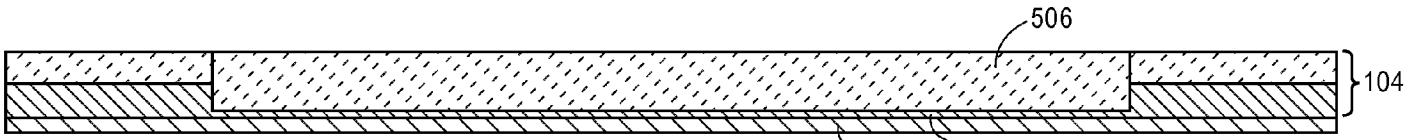
Figure 2D:
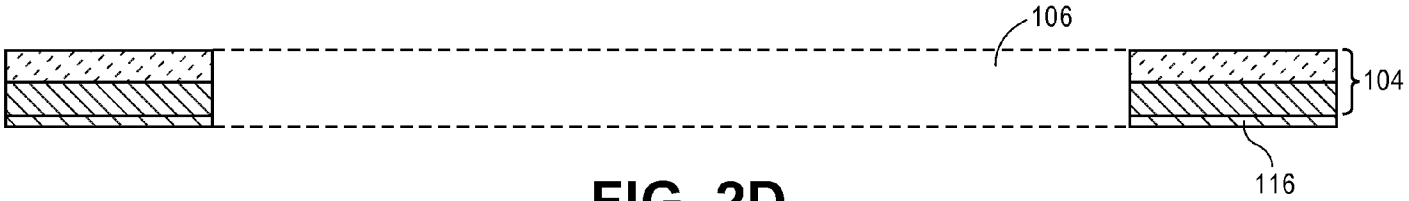

Referring to FIG. 2A, a polishing layer 104 is provided. The polishing layer 104 has a polishing side 128 and a back side 129, and has a modulus. The polishing side 128 may have grooves 105 formed therein. Referring to FIG. 2D, a first opening 106 is formed through the polishing layer 104. In one embodiment, referring to FIGS. 2B and 2C, the first opening 106 is formed by recessing a portion 506 of the polishing layer 104 from the polishing side 128 of the polishing layer 104 but not through to the back side 129 of the polishing layer 104, leaving portion 550. An adhesive layer 552 is then laminated on the back side 129 of the polishing layer 104. Referring again to FIG. 2D, the adhesive layer 552 and the back side 129 of the polishing layer 104 are cut in alignment with the recessed portion 556 of the polishing layer 104 to provide the first opening 106 in the polishing layer 104, to remove portion 550, and to leave adhesive layer 116 remaining, as is depicted in FIG. 2D. In one embodiment, the cutting is performed using an end mill or a router. Although as described above, the first opening 106 is formed through the polishing layer 104 from the polishing side 128 of the polishing layer 104, in another embodiment, the first opening 106 is formed through the polishing layer 104 from the back side 129 of the polishing layer 104.

Figure 2E:
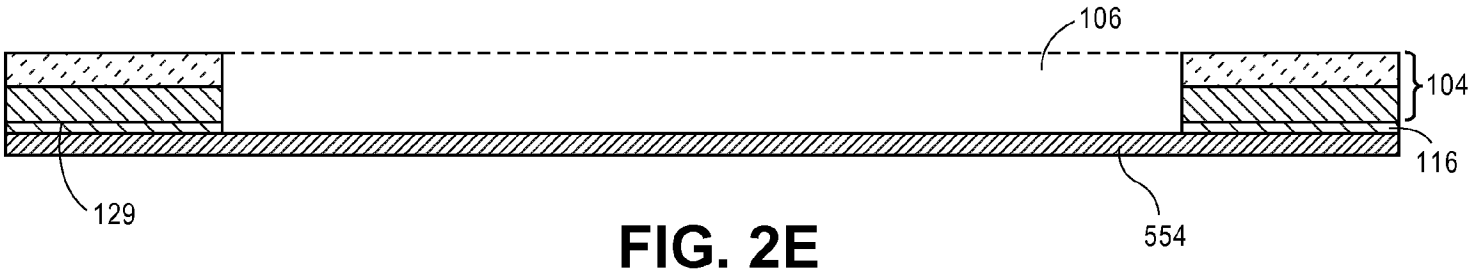
Figure 2F:
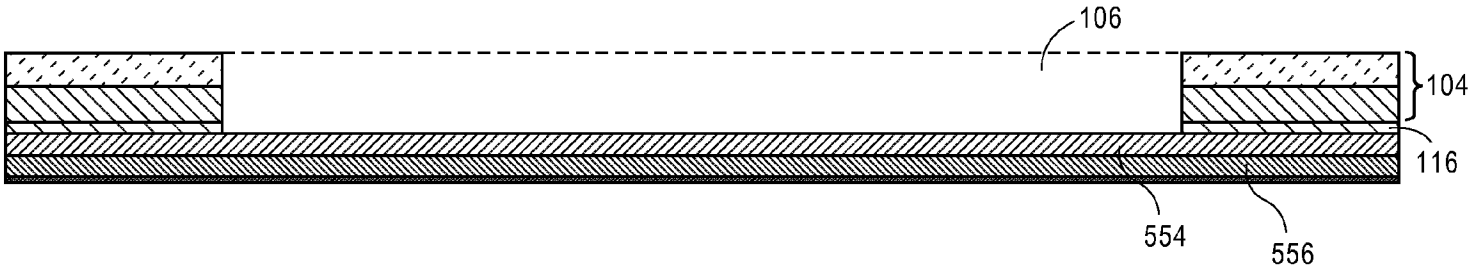
Figure 2G:
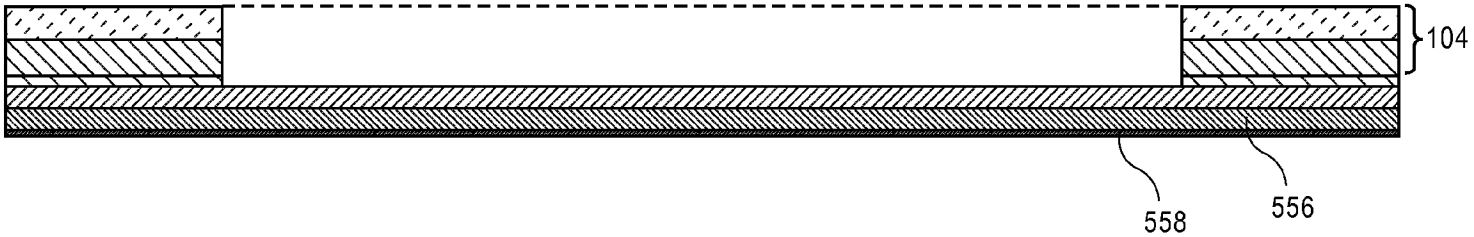
Figure 2H:
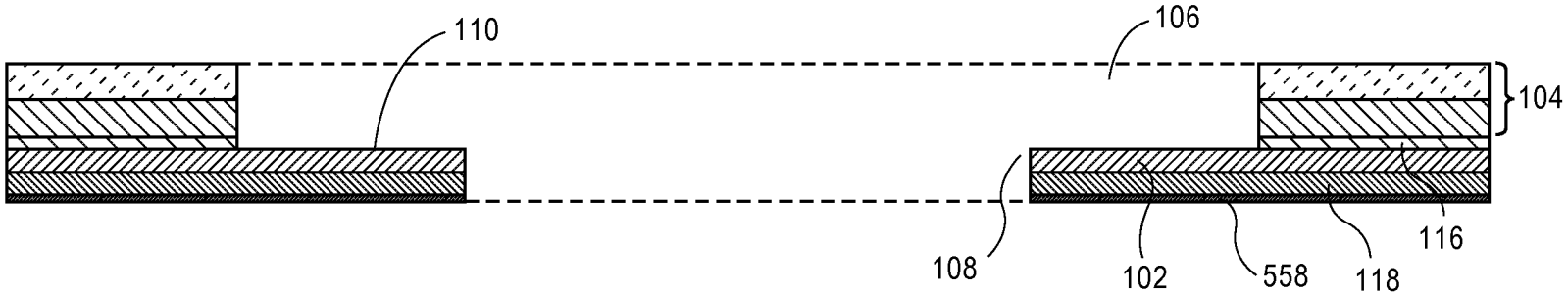

Referring to FIG. 2E, a foundation layer 554 is attached to the back side 129 of the polishing layer 104. The foundation layer 554 has a modulus greater than the modulus of the polishing layer 104. Referring to FIG. 2H, subsequent to attaching the foundation layer 554 to the back side 129 of the polishing layer 104, a second opening 108 is formed through the foundation layer 554 to provide foundation layer 102 having opening 108 there through. The first opening 106 exposes at least a portion of the second opening 108 and exposes a portion 110 of the foundation layer 102. In one such embodiment, the first opening 106 exposes the entirety of the second opening 108. In an embodiment, referring to FIGS. 2F and 2G, prior to forming the second opening 108 through the foundation layer 554, a sub pad 556 and then an adhesive layer 558 are attached to a side of the foundation layer 554 opposite a side attached to the polishing layer 104. In one such embodiment, forming the second opening 108 also involves forming an opening through in the sub pad 556 (and through adhesive layer 558, if present) to provide sub pad 118, as is depicted in FIG. 2H.

Figure 2I:
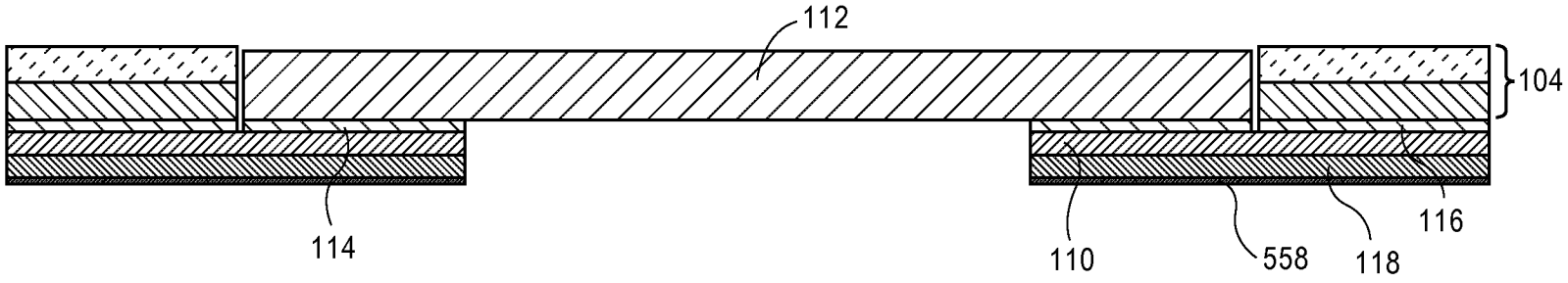

Referring to FIG. 2I, a window 112 is inserted in the first opening 106 and is attached to the exposed portion 110 of the foundation layer 102. In an embodiment, the window 112 is attached to the exposed portion 110 of the foundation layer 102 with an adhesive layer 114, as was described in association with FIG. 1A and as is depicted in FIG. 2I. In one such embodiment, the adhesive layer 114 is first attached to an outer portion of the window 112 but not to an inner portion of the window 112 (e.g., the outer portion being the portion that contacts the exposed portion 110 of the foundation layer 102), and then attaching the adhesive layer 114 to the exposed portion 110 of the foundation layer 102. In one embodiment, the adhesive layer is one such as, but not limited to, a (PSA) layer, a two-component epoxy layer, a UV-cured resin layer, a silicone-based adhesive layer, a transfer tape layer, or a hot melt layer. In a particular such embodiment, the adhesive layer is a non-differential two-sided tape PSA layer. In another particular such embodiment, the adhesive layer is a differential two-sided tape PSA layer.

In another embodiment, the window 112 is attached to the exposed portion 110 of the foundation layer 102 by welding a portion of the window 112 to the exposed portion 110 of the foundation layer 102, as is described below in association with FIG. 3. In another embodiment, the window 112 is attached to the exposed portion 110 of the foundation layer 102 by snap-fitting the window 112 to the foundation layer 102, as is described below in association with FIG. 4. In an embodiment, the window 112 is attached to the foundation layer 102 by inserting a portion of the window 112 into a portion of the second opening 108, such as the case for a T-plug, as described above.

A second exemplary polishing pad includes a foundation layer having a window attached to the foundation layer by a welded region. For example, FIG. 3 illustrates a cross-sectional view of a polishing pad with a window housed within an opening in a polishing layer and attached to an underlying foundation layer by a welded region, in accordance with an embodiment of the present invention.

Figure 3:
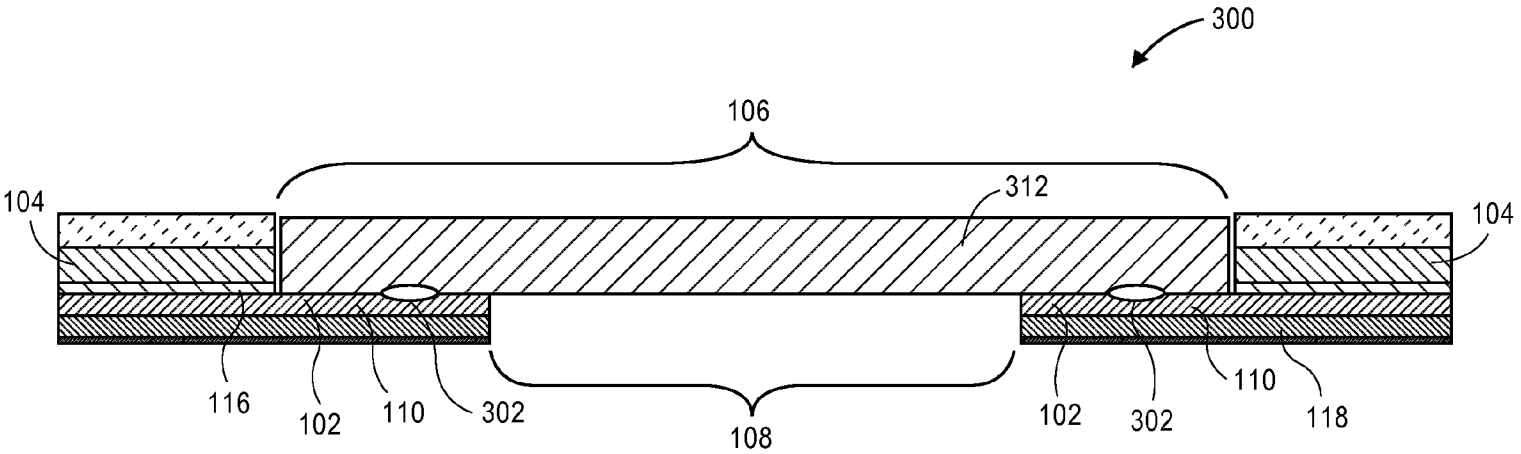
FIG. 3 illustrates a cross-sectional view of a polishing pad with a window housed within an opening in a polishing layer and attached to an underlying foundation layer by a welded region, in accordance with an embodiment of the present invention.

Referring to FIG. 3, a polishing pad 300 for polishing a substrate includes a foundation layer 102 having a first modulus. A polishing layer 104 is attached to the foundation layer 102. The polishing layer 104 has a second modulus less than the first modulus. A first opening 106 is through the polishing layer 104. A second opening 108 is through the foundation layer 102. From a plan view perspective, the first opening 106 exposes at least a portion of the second opening 108 and exposes a portion 110 of the foundation layer 102. In one such embodiment, the first opening 106 exposes the entire second opening 108.

Referring again to FIG. 3, a window 312 is disposed in the first opening 106 and is attached to the exposed portion 110 of the foundation layer 102. In an embodiment, the window 312 is attached to the exposed portion 110 of the foundation layer 102 by a welded region 302. In one such embodiment, the welded region 302 is a region such as, but not limited to, a spot weld region, a line weld region, or a multi-line weld region. Other attributes of window 312 may be as described above in association with window 112 of FIGS. 1A and 1B.

Also, other attributes of polishing pad 300 may be as described above in association with polishing pad 100 of FIGS. 1A and 1B.

A third exemplary polishing pad includes a foundation layer having a window attached to the foundation layer by a snap-fit feature. For example, FIG. 4 illustrates a cross-sectional view of a polishing pad with a window housed within an opening in a polishing layer and attached to an underlying foundation layer by a snap-fit arrangement, in accordance with an embodiment of the present invention.

Figure 4:
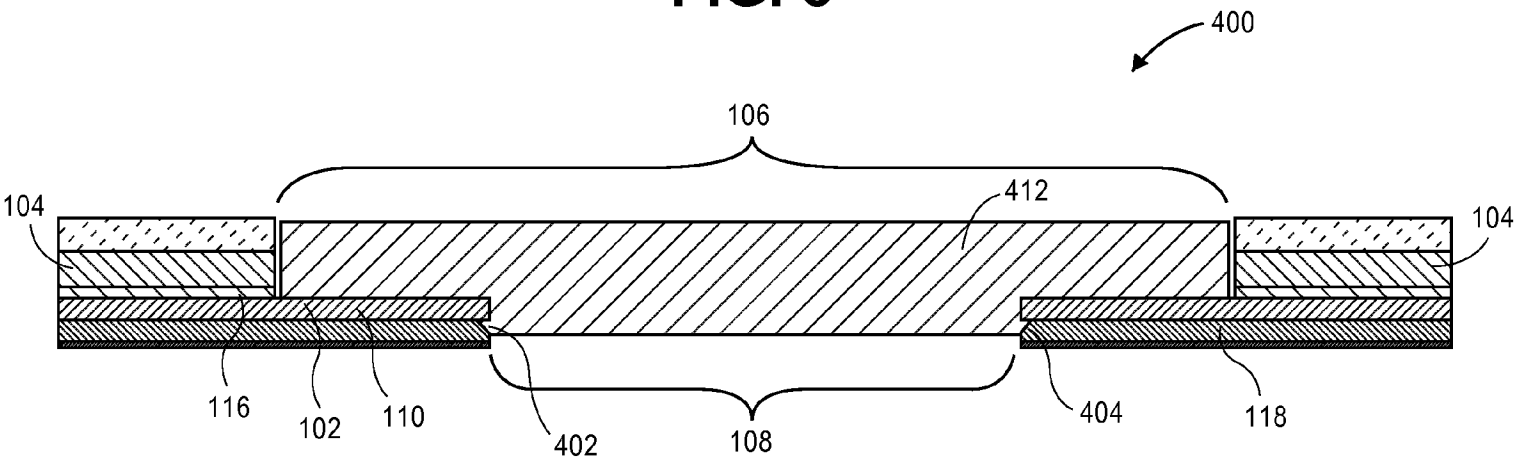
FIG. 4 illustrates a cross-sectional view of a polishing pad with a window housed within an opening in a polishing layer and attached to an underlying foundation layer by a snap-fit arrangement, in accordance with an embodiment of the present invention

Referring to FIG. 4, a polishing pad 400 for polishing a substrate includes a foundation layer 102 having a first modulus. A polishing layer 104 is attached to the foundation layer 102. The polishing layer 104 has a second modulus less than the first modulus. A first opening 106 is through the polishing layer 104. A second opening 108 is through the foundation layer 102. From a plan view perspective, the first opening 106 exposes at least a portion of the second opening 108 and exposes a portion 110 of the foundation layer 102. In one such embodiment, the first opening 106 exposes the entire second opening 108.

Referring again to FIG. 4, a window 412 is disposed in the first opening 106 and is attached to the exposed portion 110 of the foundation layer 102. In an embodiment, the window 412 is attached to the exposed portion 110 of the foundation layer 102 by a snap-fit feature 402. In one such embodiment, the snap-fit feature 402 includes a portion that clamps below a portion of the exposed region 110 of the foundation layer 102. In one embodiment, a sub pad 118 has a feature 404 (such as a bevel) for to accommodate, or formed from accommodating, the snap-fit feature 402 of the window 412. Other attributes of window 412 may be as described above in association with window 112 of FIGS. 1A and 1B. Also, other attributes of polishing pad 400 may be as described above in association with polishing pad 100 of FIGS. 1A and 1B.

It is to be appreciated that other approaches may be used to fabricate polishing pads, such as polishing pads 100, 300 and 400, in addition or as an alternate to the method described above in association with FIGS. 2A-2I. A second exemplary method of fabricating a polishing pad includes attaching a window to a foundation layer prior to attaching a polishing layer to the foundation layer. As an example, FIGS. 5A-5C illustrate cross-sectional views representing various operations in a method of fabricating a polishing pad for polishing a substrate, in accordance with an embodiment of the present invention.

Figure 5A:
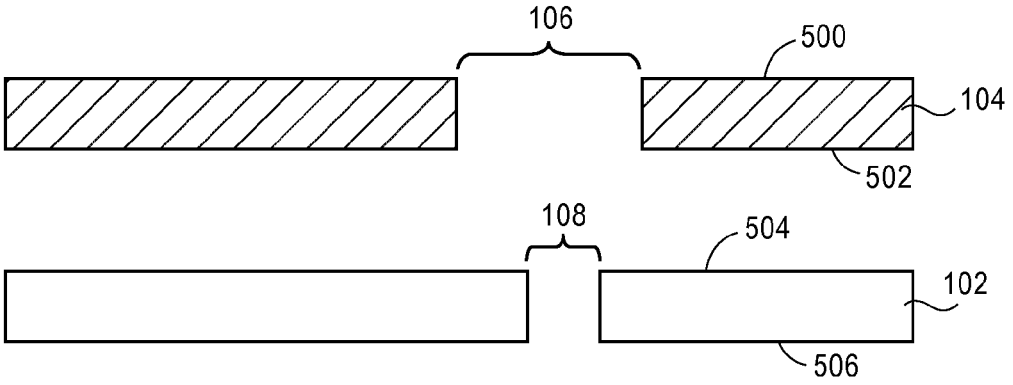
FIGS. 5A-5C illustrate cross-sectional views representing various operations in another method of fabricating a polishing pad for polishing a substrate, in accordance with an embodiment of the present invention.

Referring to FIG. 5A, a first opening 106 is formed through a polishing layer 104. The polishing layer 104 has a polishing side 500 and a back side 502 and has a modulus. A second opening 108 is formed through a foundation layer 102. The foundation layer has a polishing side 504 and a back side 506 and has a modulus greater than the modulus of the polishing layer 104. It is to be appreciated that the ordering of forming the first or second openings can be varied with respect to one another and with respect to other operations described herein.

Figure 5B:
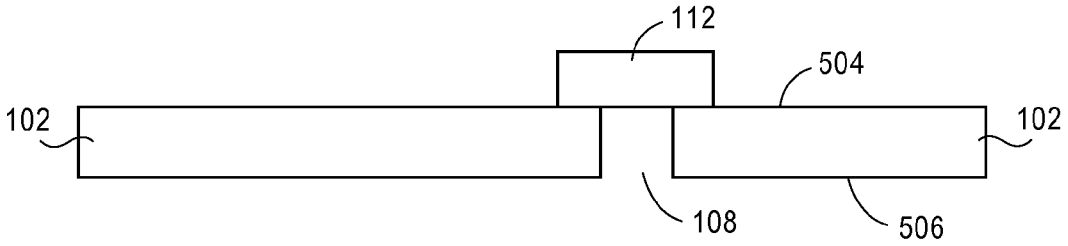
Figure 5C:
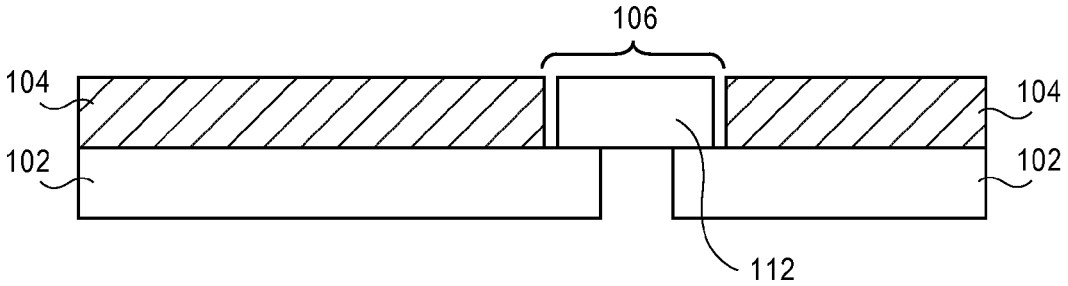

Referring to FIG. 5B, a window 112 is attached to the polishing side 504 of the foundation layer 102. The window 112 covers at least a portion of the second opening 108. In one such embodiment, the window 112 covers the entirety of the second opening 108, as is depicted in FIG. 5B.

In an embodiment, the window 112 is attached to the polishing side 504 of the foundation layer 102 with an adhesive layer, as was described in association with FIG. 1A. In one such embodiment, the adhesive layer is first attached to an outer portion of the window 112 but not to an inner portion of the window 112 (e.g., the outer portion being the portion that contacts the foundation layer 102), and then attaching the adhesive layer to the foundation layer 102. In one embodiment, the adhesive layer is one such as, but not limited to, a (PSA) layer, a two-component epoxy layer, a UV-cured resin layer, a silicone-based adhesive layer, a transfer tape layer, or a hot melt layer. In a particular such embodiment, the adhesive layer is a non-differential two-sided tape PSA layer. In another particular such embodiment, the adhesive layer is a differential two-sided tape PSA layer.

In another embodiment, the window 112 is attached to the polishing side 504 of the foundation layer 102 by welding a portion of the window 112 to the foundation layer 102, as was described in association with FIG. 3. In another embodiment, the window 112 is attached to the polishing side 504 of the foundation layer 102 by snap-fitting the window 112 to the foundation layer 102, as was described in association with FIG. 4. In an embodiment, the window 112 is attached to the foundation layer 102 by inserting a portion of the window into a portion of the second opening, such as the case for a T-plug, as described above.

Referring to FIG. 5C, subsequent to attaching the window 112 to the polishing side 504 of the foundation layer 102, the polishing layer 104 is attached to the foundation layer 102. The first opening 106 formed through the polishing layer 104 surrounds the window 112.

In an embodiment, polishing pads described herein, such as polishing pads 100, 300 or 400, are suitable for polishing substrates. The substrate may be one used in the semiconductor manufacturing industry, such as a silicon substrate having device or other layers disposed thereon. However, the substrate may be one such as, but not limited to, a substrates for MEMS devices, reticles, or solar modules. Thus, reference to "a polishing pad for polishing a substrate," as used herein, is intended to encompass these and related possibilities. In an embodiment, a polishing pad has a diameter approximately in the range of 20 inches to 30.3 inches, e.g., approximately in the range of 50-77 centimeters, and possibly approximately in the range of 10 inches to 42 inches, e.g., approximately in the range of 25-107 centimeters.

Providing context for one or more embodiments described herein, it is to be appreciated that conventional approaches to fabricating and using soft polishing pads may have limitations. For example, casted soft pads may offer low defect characteristics but compromised planarization performance. There may be a need for polishing pads that offer both low defect characteristics yet high planarization performance during polishing operations. Similarly, conventional approaches to fabricating and using hard polishing pads may have limitations. For example, faster gelling speeds possibly inherent in harder urethane formulations may force process compromises that impact pad uniformity and limit formulation options. There may be a need for an approach suitable to produce and implement hard pads that avoid such compromises. Additionally, as noted above, it may be desirable to decouple the properties of the polishing surface of a pad from its bulk properties, such that the properties of each may be separately optimized.

In accordance with an embodiment of the present invention, polishing pads with foundation layers of a material different from the material of the polishing surface are described above. Such polishing pads may be fabricated or implemented in polishing approaches suitable to address the above described compromises made for conventional pads. In one embodiment, a composite polishing pad includes a foundation fabricated from a stable, essentially non-compressible, inert material to which a polishing layer is attached. A foundation layer having a relatively higher modulus may provide support and strength for pad integrity while a polishing layer having relatively lower modulus may reduce scratching, enabling decoupling of the material properties of the polishing layer and the remainder of the polishing pad.

Polishing pads described herein may be suitable for use with a variety of chemical mechanical polishing apparatuses. As an example, FIG. 6 illustrates an isometric side-on view of a polishing apparatus compatible with a polishing pad described herein, in accordance with an embodiment of the present invention.

Figure 6:
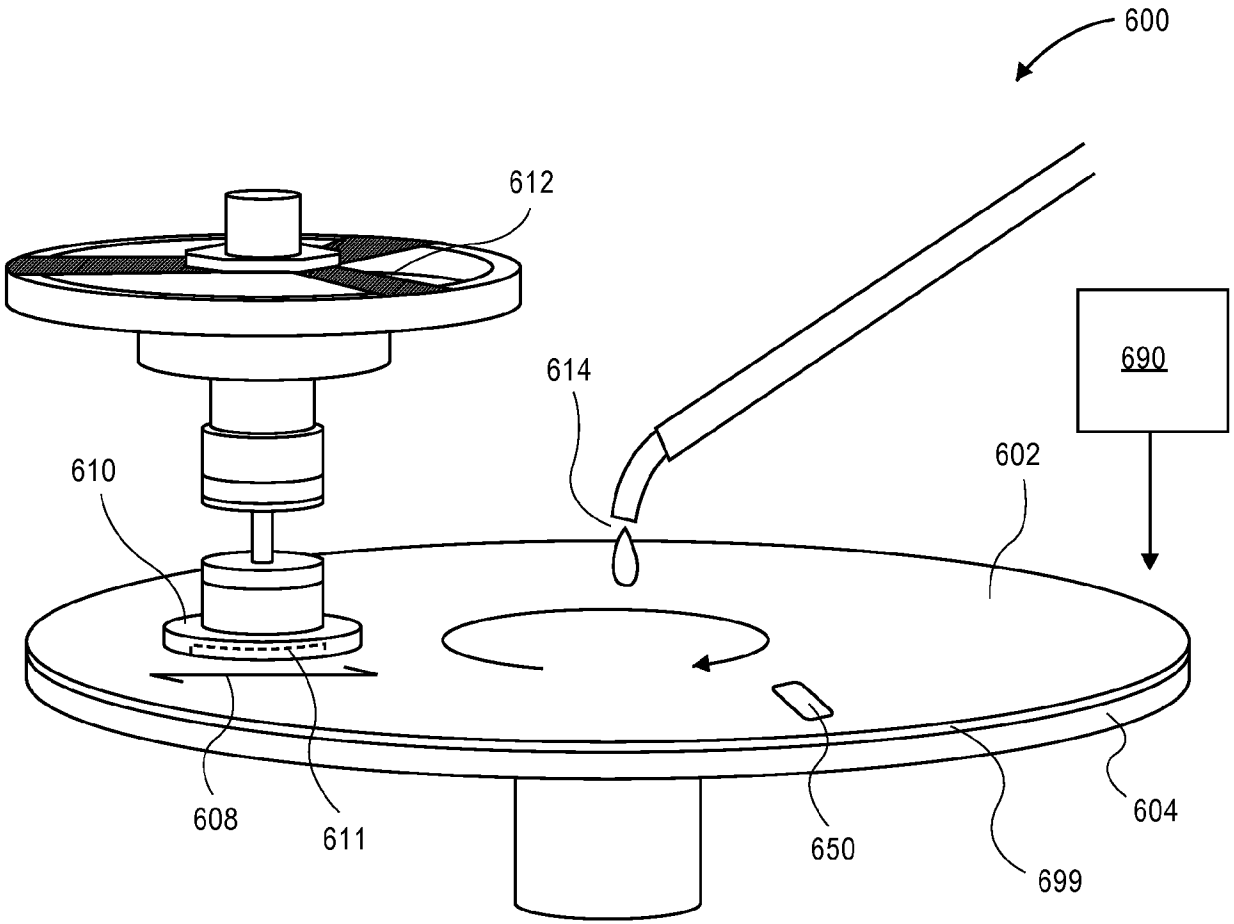
FIG. 6 illustrates an isometric side-on view of a polishing apparatus compatible with a polishing pad described herein, in accordance with an embodiment of the present invention.

Referring to FIG. 6, a polishing apparatus 600 includes a platen 604. The upper surface 602 of platen 604 may be used to support a polishing pad 699, such as a polishing pad having a polishing layer and a foundation layer, with a window attached to the foundation layer. Platen 604 may be configured to provide spindle rotation 606. A sample carrier 610 is used to hold a semiconductor wafer 611 in place during polishing of the semiconductor wafer with a polishing pad. Sample carrier 610 may further provide slider oscillation 608. Sample carrier 610 is further supported by a suspension mechanism 612. A slurry feed 614 is included for providing slurry to a surface of the polishing pad 699 prior to and during polishing of the semiconductor wafer. A conditioning unit 690 may also be included and, in one embodiment, includes a diamond tip for conditioning a polishing pad. In an embodiment, the polishing pad 699 includes a window 650 through which optical end-point detection may be performed during a CMP process.

Thus, polishing pads having a foundation layer and a window attached to the foundation layer, and methods of fabricating such polishing pads, have been disclosed. In accordance with an embodiment of the present invention, a polishing pad for polishing a substrate includes a foundation layer having a first modulus. A polishing layer is attached to the foundation layer and has a second modulus less than the first modulus. A first opening is through the polishing layer and a second opening is through the foundation layer. The first opening exposes at least a portion of the second opening and exposes a portion of the foundation layer. A window is disposed in the first opening and is attached to the exposed portion of the foundation layer.

What is claimed is:

1. A polishing pad for polishing a substrate, the polishing pad comprising:

a foundation layer having a first modulus;

a polishing layer attached to the foundation layer and having a second modulus less than the first modulus;

a first opening through the polishing layer and a second opening through the foundation layer, the first opening exposing at least a portion of the second opening and exposing a portion of the foundation layer; and a window disposed in the first opening and attached to the exposed portion of the foundation layer, wherein the window has a portion extending into the second opening, and wherein the window is attached to the exposed portion of the foundation layer by a snap-fit arrangement.

2. The polishing pad of claim 1, wherein the first opening exposes the entire second opening.

3. The polishing pad or claim 1, wherein the window is attached to the exposed portion of the foundation layer by an adhesive layer selected from the group consisting of a pressure sensitive adhesive (PSA) layer, a two-component epoxy layer, a UV-cured resin layer, a silicone-based adhesive layer, a transfer tape layer, and a hot melt layer.

4. The polishing pad of claim 3, wherein the adhesive layer is a non-differential two-sided tape PSA layer.

5. The polishing pad of claim 3, wherein the adhesive layer is a first two-sided tape PSA layer, and wherein the polishing layer is attached to the foundation layer using a second two-sided tape PSA layer having a thickness approximately the same as a thickness of the first two-sided tape PSA layer attaching the window to the foundation layer.

6. The polishing pad of claim 3, wherein the adhesive layer is a differential two-sided tape PSA layer.

7. The polishing pad or claim 1, wherein the window is attached to the exposed portion of the foundation layer by a welded region.

8. The polishing pad of claim 7, wherein the welded region is a region selected from the group consisting of a spot weld region, a line weld region, and a multi-line weld region.

9. The polishing pad of claim 1, further comprising:

a sub pad attached to the foundation layer on a side of the foundation layer opposite the polishing layer; and a third opening through the sub pad, the third opening substantially sized and aligned with the second opening.

10. The polishing pad of claim 1, wherein, from a plan view perspective of the polishing layer, the window has substantially a same shape as the first opening.

11. The polishing pad of claim 10, wherein the shape is selected from the group consisting of a circle, an oval, a square, a rectangle, and a rectangle having rounded corners.

12. The polishing pad of claim 10, wherein a perimeter of the window is reduced in size at all portions of the perimeter by an amount approximately in the range of 5-15 mils relative to a perimeter of the first opening.

13. The polishing pad of claim 1, wherein, with respect to the foundation layer, the window has an uppermost surface lower than an uppermost surface of the polishing layer.

14. The polishing pad of claim 1, wherein, from a plan view perspective of the polishing layer, the first opening has substantially a same shape as the second opening, and wherein a perimeter of the second opening is reduced in size at all portions of the perimeter by an amount approximately in the range of 10-500 mils relative to a perimeter of the first opening.

15. The polishing pad of claim 14, wherein the perimeter of the second opening is reduced in size at all portions of the perimeter by an amount approximately in the range of 100-300 mils relative to the perimeter of the first opening.

16. The polishing pad of claim 1, wherein the polishing layer is attached to the foundation layer by an adhesive layer.

17. The polishing pad of claim 1, wherein the polishing layer is attached to the foundation layer through covalent bonding of the polishing layer to the foundation layer.

18. The polishing pad of claim 1, wherein the window comprises a material selected from the group consisting of a polyethylene terephthalate material, a polyurethane material, a cyclic olefin copolymer material, a polycarbonate material, a polyester material, a polypropylene material, and a polyethylene material.

19. The polishing pad of claim 1, wherein the window comprises a material transparent to a broad spectrum irradiation approximately in the range of 300-800 nanometers.

20. The polishing pad of claim 1, wherein the foundation layer has an energy loss factor of less than approximately 100 KEL at 1/Pa at 40° C.

21. The polishing pad of claim 1, wherein the foundation layer comprises a material selected from the group consisting of a polycarbonate material, an epoxy board material, a polyurethane material, a composite fiber board, a polymethylmethacrylate (PMMA) material, and a cyclic olefin copolymer material.

22. The polishing pad of claim 1, wherein the polishing layer has an energy loss factor of greater than approximately 1000 KEL at 1/Pa at 40° C.

23. The polishing pad of claim 1, wherein a combination of the foundation layer and the polishing layer has an energy loss factor of less than approximately 1000 KEL at 1/Pa at 40° C.

24. The polishing pad of claim 1, wherein the polishing layer comprises a thermoset polyurethane material, the foundation layer comprises a polycarbonate layer, and the window comprises a polyethylene terephthalate material.

25. The polishing pad of claim 1, wherein the polishing layer has an elastic storage modulus (E') at 40 degrees Celsius approximately in the range of 50 MPa-100 MPa, and wherein the foundation layer has an elastic storage modulus (E') at 40 degrees Celsius approximately in the range of 1500 MPa-3000 MPa.

26. The polishing pad of claim 1, wherein the foundation layer has a hardness approximately in the range of 70-90 Shore D, and the polishing layer has a hardness approximately in the range of 20-65 Shore D.

27. The polishing pad of claim 1, wherein the polishing layer has grooves disposed therein, the grooves formed to a depth of approximately 10%-60% of a total thickness of the polishing layer.

28. The polishing pad of claim 27, wherein the grooves are formed to a depth of approximately half of the total thickness of the polishing layer.

* * * * *